United States Patent [19]

Bonanno et al.

[11] Patent Number: 4,637,407

[45] Date of Patent: Jan. 20, 1987

[54] CIGARETTE HOLDER

[75] Inventors: Mario Bonanno, Whiting, N.J.; George Zinonos, Astoria; Constantin Trantzas, Jackson Heights, both of N.Y.

[73] Assignee: Cangro Industries, Inc., Farmingdale, N.Y.

[21] Appl. No.: 706,650

[22] Filed: Feb. 28, 1985

[51] Int. Cl.[4] ..... A24F 7/04

[52] U.S. Cl. ..... 131/175; 131/178; 131/187; 131/195; 131/198.1

[58] Field of Search ..... 131/178, 330, 175, 187, 131/195, 198.1

[56] References Cited

U.S. PATENT DOCUMENTS 4,164,230 8/1979 Pearlman ..... 131/330

*Primary Examiner*—V. Millin

*Attorney, Agent, or Firm*—Eisenman, Allsopp & Strack

[57] ABSTRACT

A fire safe, environmentally protective cigarette holder for fully enveloping a lit cigarette and in which an internal power source maintains a flow of air to the lit portion and drives the exhaust smoke through a filter before it is vented to the atmosphere, thus filtering products of combustion which are not drawn in by the smoker. Additional filtering means which can include the cigarette itself can be utilized to filter the drawn smoke.

5 Claims, 4 Drawing Figures

CIGARETTE HOLDER

BACKGROUND OF THE INVENTION

This invention relates to cigarette holders for protecting both against fire and environmental pollution from smoke.

Many devices have been proposed for protecting against fires started by the burning tip of a cigarette. Representative of such devices are those shown in U.S. Pat. Nos. 1,821,267, 2,499,733, 2,625,163 and 4,289,149. The most effective designs are those which do not provide direct or straight line openings between the burning tip of the cigarette and the environment, but the more tortuous the path, the more difficult it becomes to maintain a sufficient air supply to maintain combustion. In addition to fire hazards cigarette smoke is a serious polluter of the atmosphere. Even in the case of filtered cigarettes, the filter portion essentially protects the smoker by filtering out certain contaminants from the smoke actually drawn in by the smoker. The majority of the time, however, the cigarette is free burning so that totally unfiltered products of combustion permeate the atmosphere directly from the burning tip.

It is the object of the present invention to provide a cigarette holder which protects against fires by isolating the burning cigarette or bits thereof which might separate from the cigarette and which filters substantial portions of the products of combustion discharged to the atmosphere.

It is another object of the invention to provide a cigarette holder which automatically extinguishes the cigarette when it reaches a predetermined butt length, and which in addition provides for automatic extinguishment at any point along its length by the action of the smoker.

Another object of the invention is to provide a substantially closed cigarette holder in which the flow of air through the unit provides cooling of critical exposed parts of the holder.

Another object of the invention is to provide a cigarette holder which effectively contains all of the ash particles which fall from the burning tip of the cigarette.

SUMMARY OF THE INVENTION

In accordance with the invention there is provided a cigarette holder which entirely encloses the cigarette and which provides for a tortuous inlet air path which protects the environment from the burning cigarette and precludes burning coals or ash from leaving the holder when detached from the cigarette, with the air path being so arranged that inlet air cools selected portions of the holder. A motor driven air impeller within the holder assures a continuous flow of fresh air to the burnable portion of the cigarette even when the smoker is not drawing. When the cigarette is free burning, the impeller drives the smoke through a filter which can either be independent of or embodied in the filter of the cigarette with the filtered products of combustion being vented to the atmosphere. The impedance of the inlet and discharge flow paths out of the holder is so arranged in relation to the power of the impeller that the rate of combustion is reduced as close as possible to the minimum necessary to maintain combustion. The holder thus serves both to protect the environment from fire, from ash and from air pollution. The admission of fresh air to the burnable body portion of the cigarette is so arranged that the cigarette will automatically extinguish itself when the cigarette has burned to a point close to the filter. In addition, a control is provided for the motor so that the air impeller can be stopped at the will of the smoker causing the cigarette to extinguish itself regardless of the amount previously burned. The casing for the holder is separable so that the used cigarette as well as the ash can be removed and a fresh cigarette and replacement filters when needed can be readily inserted.

BRIEF DESCRIPTION OF THE DRAWING

A preferred embodiment of the invention is illustrated in the drawings in which.

DESCRIPTION OF THE PREFERRED EMBODIMENT

Figure 1:
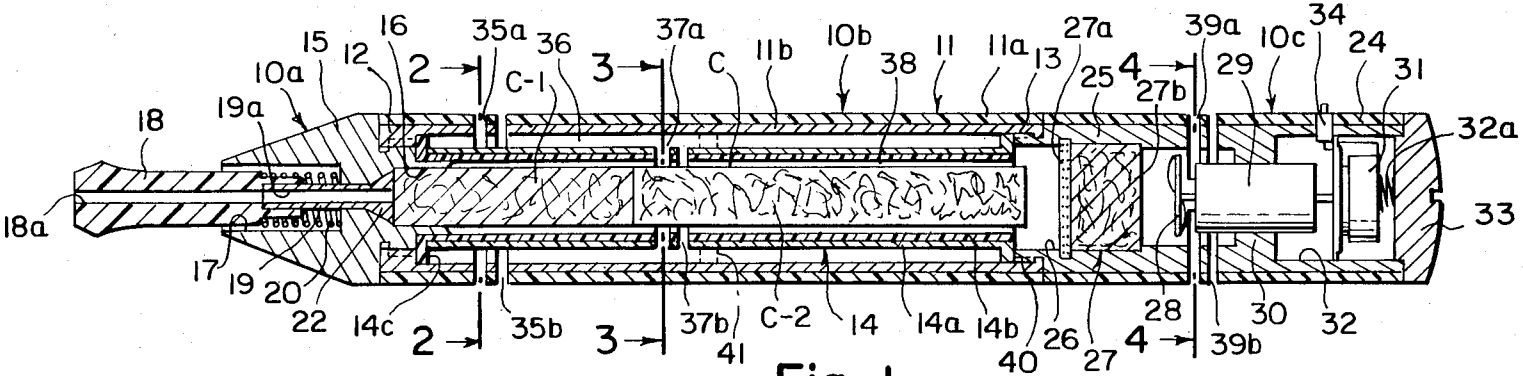
FIG. 1 is a view in enlarged scale in cross section through the central axis taken on the horizontal plane 1—1 of FIG. 2.
Figure 4:
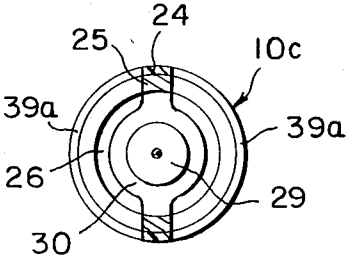
FIG. 4 is a view in transverse section taken on the line 4—4 of FIG. 1.
Figure 3:
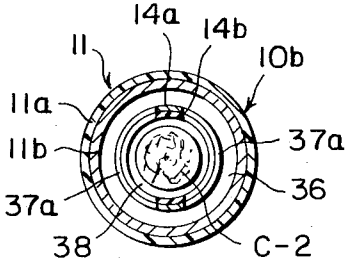
FIG. 3 is a view in transverse section taken on the line 3—3 of FIG. 1.
Figure 2:
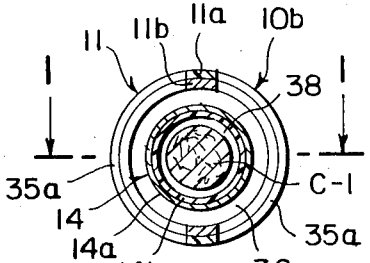
FIG. 2 is a view in transverse cross section taken on the line 2—2 of FIG. 1.

Referring to FIG. 1, the invention is illustrated as embodied in a cigarette holder having three separable sections including a mouthpiece section 10*a*, a central body section 10*b* and a power section 10*c* at the outer end. The central body section 10*b* includes a laminated outer sleeve 11 having an exposed layer 11*a* of relatively low heat conductivity such as Teflon and an inner layer 11*b* of metal such as aluminum, the latter having a shoulder 12 at its inner end and coupling threads 13 at its outer end. Mounted concentrically within the outer sleeve 11 and spaced therefrom is a telescoping double-walled inner sleeve 14 comprising a metal outer tubular portion 14*a* formed with a spacing shoulder at its right hand end flange. Received within the outer portion 14*a* in a close sliding fit is an inner tubular portion 14*b* having a spacing shoulder 14*c* at its left hand end and formed of a fire resistant material such as Teflon.

The mouthpiece section 10*a* includes body portion 15 having a cylindrical opening 16 adapted to receive the inner or filter end C-1 of the cigarette C in a friction fit. A second cylindrical recess 17 receives a disposable tip or mouthpiece 18 to which is attached a cigarette ejector or plunger 19. A compression spring 20 urges the plunger and tip to the left until the plunger head portion 22 seats on body portion 15. To eject the cigarette when the holder is opened by removing power section 10*c*, the tip 18 is pressed inwardly causing the plunger 19 to force the cigarette butt out of the cylindrical opening 16.

The power section 10*c* includes an outer cylindrical sleeve 24 preferably formed of the same material as the central sleeve portion 11*a* and an inner housing portion 25 having a first chamber 26 for holding an expendable filter 27 having a preliminary screen 27*a* for large particulate matter and a filtering body portion 27*b* of, for example, compressed carbon granulars or other suitable filtering medium. Also mounted in the chamber 26 is an air impeller in the form of a fan blade 28 driven by an electrical motor 29 supported by a central boss 30. The motor is energized by a battery 31 contained in a chamber 32 at the outer end of the holder held in place by a spring 32*a* and a removable cap portion 33. An electrical switch 34 accessible at the outer end of the holder enables the smoker to energize the motor and its impeller.

The air paths from the atmosphere to the burnable body of the cigarette and from the burnable body to the atmosphere are critical to certain features of the invention. A first path from the cigarette to the atmosphere is provided by the central bores 18*a* and 19*a* in the mouthpiece and ejection plunger respectively through which smoke is inhaled by the smoker. The fresh air path from the atmosphere to the burnable body C-2 of the cigarette is provided by a first pair of semi-circular slots 35*a* and 35*b* in the outer sleeve 11 at a point near the inner end of the cigarette and in any event well beyond the burnable body thereof. The radial spacing between the outer sleeve 11 and the inner sleeve 14 forms an air path or duct 36 for the air drawn in through the ports 35*a* and *b*. This relatively cool air maintains an acceptably low temperature for the outer sleeve near the mouthpiece. A second pair of semi-circular ports 37*a* and 37*b* pierces the inner sleeve 14 at a point along the length of the burnable body C-2 of the cigarette closely adjacent the filter tip C-1. The inside diameter of the inner sleeve 14*b* is larger than the outside diameter of the cigarette providing a second air duct 38 along the length of the burnable body C-2. Thus, when the smoker inhales, fresh air will enter the ports 35*a* and *b*, and pass along the internal duct 36 to the ports 37*a* and *b*, and along the duct 38 until the burning tip of the cigarette is reached, with the products of combustion passing through the length of the cigarette, its filter C-1 and the mouthpiece of the holder. When the cigarette is free burning, the air flow induced by the impeller 28 follows the same paths to the burning tip, but at substantially reduced rates and the negative air pressure induced at the right hand end of the chamber 26 between the filter 27 and the impeller 28 draws the smoke through the filter past the impeller blades and out of a pair of semi-cylindrical ports 39*a* and 39*b*.

The cigarette may be extinguished at any point along its length by turning off the impeller by means of the switch 34. If combustion continues until the burning tip reaches the ports 37*a* and *b*, the cigarette will quickly thereafter extinguish itself before it reaches the filter due to the inability of the air flow to move to the left after passing through the ports 37*a* and *b*.

The cigarette butt, the accumulated ash and, if desired, the filter 27 can be removed from the holder by first separating the power section 10*c* from the central body section 10b at the threaded coupling 40. The butt is ejected by pressing inwardly on the mouthpiece 18. The battery 31 can be replaced by removing the threaded cap 33.

A second embodiment of the invention is adapted for cigarettes embodying their own filter (as shown in Figure 1) and that filter can be used to filter both the smoke as drawn in by the smoker and the smoke from the tip from the free burning cigarette as driven by the impeller 28. Referring to FIG. 1, it will be understood that to achieve this embodiment of the invention the outer air duct 36 is extended through the housing 25 to the right as shown in the drawing to the air ports 39*a* and *b* which are open to the chamber 26 behind the impeller, as shown, but which are closed to the outside by eliminating the ports in the outer sleeve 24. The pitch of the impeller 28 is reversed and the filter 27 omitted so that the fresh air drawn in through the ports 35*a* and *b* by the impeller 28 first impinges against the burning tip of the cigarette, with the products of combustion thereafter passing through the cigarette, its filter C-1 and the mouthpiece. When the cigarette is free burning, the filtered smoke discharged through the tip will be relatively little to the impedance of the flow paths. In this embodiment the inner ports 37*a* and *b* are eliminated, or alternatively a barrier 41 (shown in phantom lines) is provided on the inside of the inner sleeve to abut snugly against the burnable body of the cigarette adjacent its inner end. When the cigarette burns beyond the barrier 41, if the ports 37*a* and *b* are kept, the products of combustion will simply be recirculated until the cigarette is extinguished. If the ports 37*a* and *b* are eliminated, the cigarette will not extinghish itself until the filter is reached.

If a second and supplementing filter is desired in this embodiment in addition to the filter C-1 of the cigarette, such can be included by providing an enlarged chamber in the mouthpiece section 10*a* to contain the filter. In the event such double filtration is excessive for the purposes of the smoker due to elimination of most of the taste of the cigarette, a resilient flap forming a right-to-left by-pass valve can be provided around the second filter which is activated by the relatively more powerful draw of the smoker, whereas it will restrain the flow of the relatively light air pressure generated by the impeller. In the event a non-filter tip cigarette is used in the holder, the second filter will assume the function of the filter 27 in that it will filter impeller driven smoke from the free burning cigarette but relatively little of the smoke drawn in by the smoker.

It will be understood that other motors can be used in place of the battery driven electrical motor shown in FIG. 1. For example, a conventional wind up spring motor can be used including a relatively strong coil spring energized by a leveraged winder which can be activated by a rotatable tip portion on the holder. Such spring motor can include a conventional speed governor to prolong the drive time achieved from a single winding of the spring. It should also be understood that if desired supplemental extension pieces can be inserted in the chamber 16 to accommodate cigarettes of shorter length, thus permitting a shorter cigarette to be burned to a point close to its end. The invention should not therefore be regarded as limited except as defined by the following claims.

We claim:

1. A fire-safe environmentally protective cigarette holder for discharging only filtered smoke to the environment both when the smoker is drawing and when the cigarette is free burning, comprising a closed casing for containing at least the burnable body portion of the cigarette;

an air inlet port in the casing;

duct means to direct fresh air from the inlet port to the burnable body portion of the cigarette;

motor driven impeller means to move the air from the inlet port to the burnable body to maintain combustion when the smoker is not drawing;

a discharge port for the products of combustion and filter means in the path of discharge, whereby the impeller means and the smoker when drawing provide parallel impelling forces for the airflow from the inlet port to the burnable body.

2. A cigarette holder according to claim 1, said casing including an inner sleeve and a concentric outer sleeve, a mouthpiece at one end of the casing, said impeller means being disposed at the end of the holder remote from the mouthpiece, said filter means comprising filter between the burnable body and the impeller means, said discharge port being disposed on the output side of the impeller.

3. A cigarette holder according to claim 1, including a filter tipped cigarette, said discharge port for the products of combustion comprising the mouthpiece of the cigarette and said filter means comprising the filter in the cigarette.

4. A cigarette holder according to claim 2, said mouthpiece including a releaseable holder for the mouthpiece portion of the cigarette, said inner and outer sleeve portions of the casing being radially spaced apart to form a first of the duct means portion, said inner sleeve having a larger inside diameter than the outside diameter of the cigarette to form a second portion of the duct means, said air inlet port in the casing being disposed in the outer sleeve adjacent the mouth end of the cigarette and air port means in the inner sleeve connecting the first duct portion to the second duct portion and disposed at a point near the inner end of the burnable body portion cigarette.

5. A cigarette holder as set forth in claim 1, said motor driven impeller means including a battery powered electric motor, and switch means for operating the motor.

* * * * *